US006085716A

United States Patent [19]

Kampichler et al.

[11] Patent Number: 6,085,716

[45] Date of Patent: Jul. 11, 2000

[54] DEVICE FOR INTERRUPTING THE FUEL SUPPLY

[75] Inventors: Guenter Kampichler, Ruhstorf; Albert Madl, Stubenberg, both of Germany

[73] Assignee: Motorenfabrik Hatz GmbH & Co. KG., Ruhstorf, Germany

[21] Appl. No.: 09/244,346

[22] Filed: Feb. 4, 1999

Related U.S. Application Data

[63] Continuation of application No. PCT/EP97/04261, Aug. 5, 1997.

[30] Foreign Application Priority Data

Aug. 5, 1996 [DE] Germany ..... 196 31 652

[51] Int. Cl.[7] ..... F02B 77/08

[52] U.S. Cl. ..... 123/198 DB; 123/198 D; 123/446

[58] Field of Search ..... 123/198 D, 198 DB, 123/449, 446, 447

[56] References Cited

U.S. PATENT DOCUMENTS

| | | | |
|---|---|---|---|
| 2,582,483 | 1/1952 | Hallerberg . | |
| 3,176,672 | 4/1965 | Rowe et al. | 123/198 D |
| 4,080,946 | 3/1978 | Cunningham | 123/198 DB |
| 4,329,954 | 5/1982 | Dobbs | 123/198 D |
| 4,368,708 | 1/1983 | Fried et al. | 123/452 |
| 4,448,165 | 5/1984 | Skinner | 123/179.17 |
| 4,811,710 | 3/1989 | Schmitt et al. | 123/359 |

FOREIGN PATENT DOCUMENTS

| | | |
|---|---|---|
| 1476112 | 9/1969 | Germany . |
| 9203912 | 9/1993 | Germany . |
| 142049 | 4/1920 | United Kingdom . |
| 1136761 | 2/1969 | United Kingdom . |
| 2069056 | 1/1980 | United Kingdom . |

*Primary Examiner*—Erick Solis
*Assistant Examiner*—Brian Hairston
*Attorney, Agent, or Firm*—Helfgott & Karas, P.C.

[57] ABSTRACT

The invention relates to an internal combustion engine, in particular a one cylinder diesel engine, with a fuel injection system. The engine is provided with a mechanical control device comprising an actuator and a control element for automatic interruption of the fuel supply in case of a lack of lubricating oil. The control circuit actuator is equipped with a vacuum advance (15) with a membrane (12) for the pressurization of a closing tappet (10), in which a pressure chamber, formed by the membrane (12) and the vacuum advance (15), is open to the atmosphere. In addition, the control conduit (18) is equipped with a connection (20) on the side of the oil circuit and a connection (22) on the side of the crankcase, in order to produce a depression the control unit.

11 Claims, 4 Drawing Sheets

DEVICE FOR INTERRUPTING THE FUEL SUPPLY

This application is a continuation of PCT/EP97/04261 filed Aug. 5, 1997.

The present invention relates to an internal combustion engine, especially a one-cylinder diesel engine with fuel-injection system, in which a mechanical safety device is provided for automatic interruption of the fuel supply in the event of lubricating-oil deficiency.

In modern internal combustion engines, operating reliability and service life are cost-deciding aspects for the purchaser. It is therefore of particular importance to prevent major damage to the overall system in the event of failure of individual components.

Severe oil-pressure drop in internal combustion engines is generally caused by low oil level in the oil pan, clogging of the oil filter, defective oil pump or clogging or leak in the oil loop. The resulting lubricating-oil deficiency at the bearing points leads within an extremely short time to serious damage to the engine, possibly as bad as complete destruction thereof. Certainly the oil pressure is in many cases indicated to the operator of the internal combustion engine by appropriate indicating instruments, but the pressure signal therefor is usually first transformed to an electrical signal, which is delivered to the indicating instrument and transformed, for example, to a mechanical movement of a pointer. The sensors and indicators are therefore susceptible to malfunctioning. Furthermore, quick response of the operator in switching off the internal combustion engine is a prerequisite for avoiding major damage thereto.

Since the quick manual action of the operator needed in this situation is not always assured, the necessity exists for provision of automatic interruption of the fuel supply in the event of lubricating-oil deficiency.

For this purpose, a mechanically acting device, such as described in German Patent DE A 1476112, is preferred to an electrical control system, in the first place for space and cost reasons, especially for small diesel engines. In many such cases, an electrical system is not even installed, since small diesel engines are equipped with manual starting devices, cranks or reversing starts. Moreover, an electrical sensor system for oil-pressure measurement is susceptible to problems.

The object of the present invention is therefore to provide a simple mechanical control system which ensures automatic fuel interruption in the event of lubricating-oil deficiency and which enables problem-free resumption of the fuel supply after an interruption.

This object is achieved according to the invention by the features of claims 1 and 10. Advantageous embodiments are described in the dependent claims.

According to the invention, a reduced pressure can be created in the control element by the principle that lubricating oil is sucked in at the connection on the oil-loop side and, because of the flow and pressure conditions prevailing in the crankcase, emerges from the connection on the crankcase side into the crankcase. In this connection, an oscillating pneumatic pressure is generated in the crankcase by the reciprocating movement of the piston. This pneumatic internal pressure is influenced by the chosen venting system and the blow-by flow. A model actuated by pressurized oil is possible as an alternative. In both versions, a lubricating-oil deficiency leads to a pressure change in the control line, causing the final controlling element to bring about interruption of the fuel supply.

According to an advantageous embodiment, the final controlling element of the control loop is provided with a reduced-pressure cell with a diaphragm for imposing pressure on a closing tappet, a pressure chamber defined by diaphragm and reduced-pressure cell being open to the atmosphere.

Hereby a purely mechanical control system is achieved in simple manner with pneumatically actuated final controlling element.

Furthermore, there is provided a restoring spring which acts on the diaphragm for automatic release of the fuel feed.

By this provision there is achieved simple, automatic resumption of the fuel supply after the cause of the lubricating-oil pressure drop has been eliminated.

According to the invention, the fuel-injection system is provided with a fuel-injection pump with suction hole, as well as a closing tappet for closing the suction hole.

Thereby there is ensured immediate interruption of the fuel feed without after-running of the engine. Furthermore, already existing machines can be easily retrofitted.

An advantageous embodiment of the invention provides that the closing tappet is permanently joined to the diaphragm.

This can be achieved in simple manner by providing, in the central region of the diaphragm, a pressure plate joined interlockingly with the tappet. Hereby the tappet can be moved both forward and back by the diaphragm.

In this connection it is provided according to the invention that the restoring spring acts on a pressure plate on the side opposite the diaphragm. This simultaneously seals the fuel zone from the reduced-pressure zone.

The pressure plate permits fixing of the spring by a recess adapted to the spring shape, thus permitting good guidance and exact calculation of the spring force acting on the diaphragm, since the forces are always directed perpendicularly.

Also expedient is the embodiment comprising a self-centering closing tappet.

The closing tappet can be constructed, for example, from elastic plastic or as a helical spring and can be provided with a valve body of hemispherical or conical form, so that the tappet centers itself directly upstream from the suction hole of the fuel-injection pump. Assembly can be greatly simplified and production costs reduced by the fact that there is no need for a suction-hole adapter attached at a specified position in the housing.

In this connection it is particularly advantageous according to the invention to provide two throttles in the control line, one downstream from the connection on the oil-loop side and the other upstream from the connection on the crankcase side, in order to make the line pressure independent of oil viscosity and delivery flow of the oil loop.

This pressure, measured in the region between the two throttles, is decoupled from and is always much lower than the oil pressure of the oil loop. If in the event of oil deficiency the oil pressure between the first and second throttles sinks beyond a limit value, the pressure values which result from superposition of the pneumatic reduced-pressure peaks themselves exhibit reduced-pressure peaks. This signal is needed in the control loop to trip interruption of the fuel supply.

It is also advantageous to provide, in the control line, a throttle downstream from the connection on the oil-loop side and a valve upstream from the connection on the crankcase side. Thereby the engine is prevented from automatically stopping already during the starting process, or in other words when sufficient oil pressure is not yet present. This is achieved by ensuring that the entire volume of the reduced-pressure cell is not evacuated all at one time but instead is evacuated stepwise during return movement of the engine piston.

Finally, it is provided according to the invention that a line, in communication at one end with the reduced-pressure cell, is disposed in the control element for evacuating and ventilating the pressure chamber. At its other end, this line is in communication via a check valve with the control line and, moreover, via a ventilation throttle with the atmosphere.

The aforesaid reduced-pressure peaks each open the check valve briefly. Thereby pressure equalization between the pressure chamber of the reduced-pressure cell in communication with the line takes place with the control line. This leads to a reduced pressure in the reduced-pressure cell. The constant reduced pressure in the one pressure chamber and the atmospheric pressure in the other pressure chamber cause the closing tappet to be pushed by the diaphragm toward the suction bore, ultimately closing it. Thereupon the fuel feed to the injection pump is interrupted and the engine is stopped.

Once the engine has stopped, the ventilation throttle acts through the restoring spring and allows the diaphragm to be repositioned, thus bringing the closing tappet to readiness for starting again. Since air is sucked in through this throttle and the build-up of reduced pressure in the reduced-pressure cell is influenced even when the stopping device is in action, the diameter of the throttle must be matched to the system. Influencing factors in this respect can be the crankcase volume, the dead volume of the line, the diaphragm volume and the venting system. Ingress of dirt can be prevented in this case by installing a filter upstream.

In a further advantageous embodiment of the present invention, an evacuating device is provided for manual evacuation of the reduced-pressure side of the diaphragm. Thus, by manual actuation of the evacuation device, the engine can be brought to starting readiness by brief manipulation of the interruption device during the starting phase, or in other words when the oil pressure in the reduced-pressure cell is not yet sufficient. For this purpose an additional reduced pressure is generated in the reduced-pressure cell.

In a particularly advantageous embodiment, a rubber bellows with compression spring is provided as the evacuation device. In this case, air is sucked from the vacuum side of the diaphragm by means of the rubber bellows.

The invention will be explained hereinafter by means of advantageous embodiments with reference to the drawings, wherein FIG. 1 shows a first embodiment schematically in a sectional representation;

Figure 1:
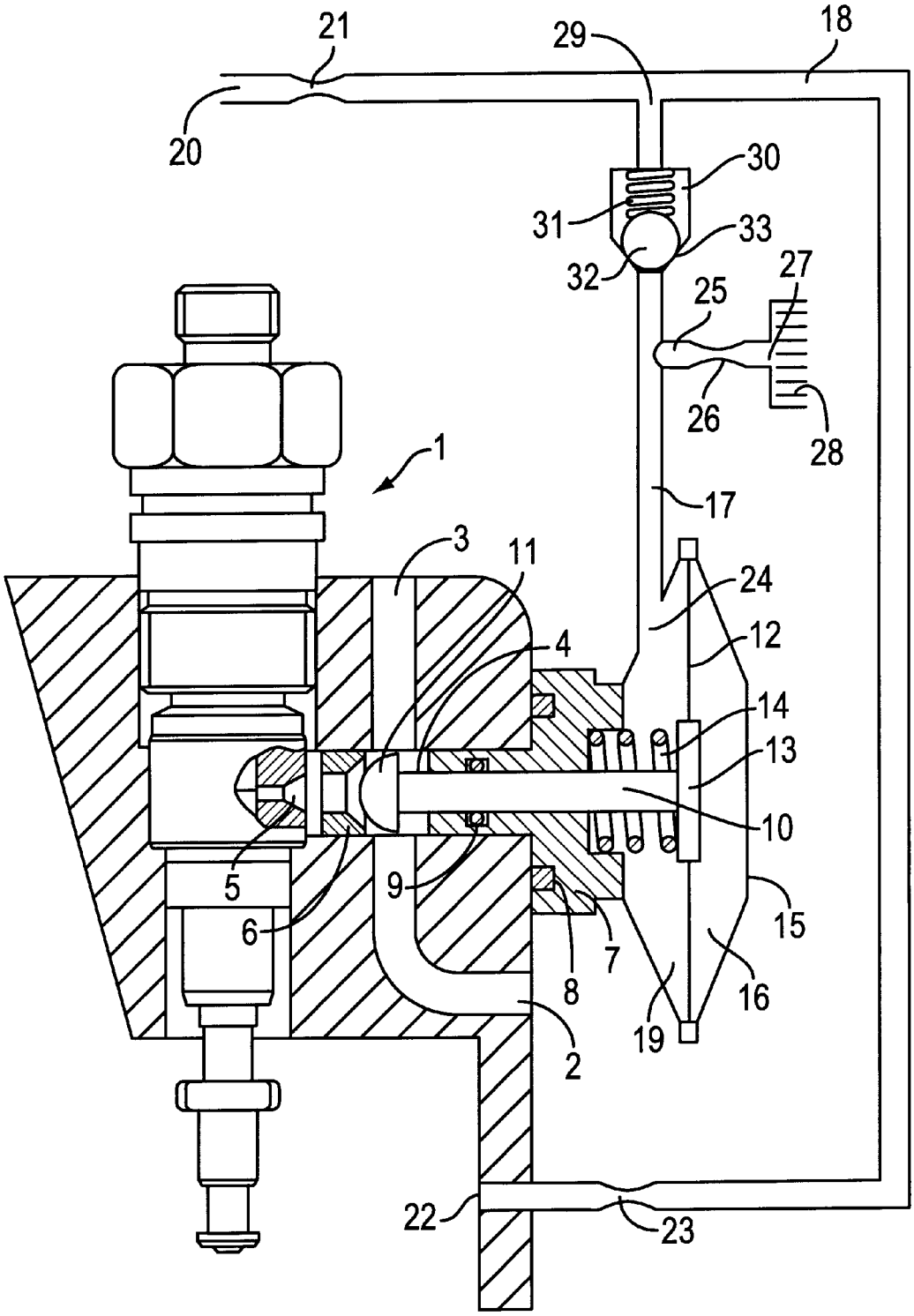

FIG. 1 schematically shows a fuel-injection pump 1 with a fuel-feed line 2 and a fuel-return line 3, each provided with a connection to the intake duct 4 with intake bore 5 and suction-hole adapter 6. In intake duct 4 there is disposed to fit exactly the pressure plate 7, which is sealed from reduced pressure by the O-ring seal 8. Furthermore, an O-ring seal 9 is provided inside pressure plate 7 in order to seal the closing tappet 10 with its hemispherical sealing head 11. This closing tappet 10 is joined interlockingly with a pressure plate 13 disposed centrally on the diaphragm 12. Between pressure plate 7 and pressure plate 13 there is disposed a restoring spring 14, which is constructed as a helical spring and which is guided laterally by a cylindrical recess in pressure plate 7. Diaphragm 12 divides the reduced-pressure cell 15 into a pressure chamber 16 open to the atmosphere and a second pressure chamber 19 in communication with the control line 18 via the loop 17. Control line 18 is provided with a connection 20 and downstream throttle 21 on the side of the oil line and with a connection 22 with upstream throttle 23 on the crankcase side. At its lower end, line 17 is provided with a connection 24 to pressure chamber 19 of reduced-pressure cell 15. Furthermore, line 17 is provided with a branch 25 containing a throttle 26, an aperture 27 open to the atmosphere and a filter 28 disposed upstream therefrom. Moreover a check valve 30 comprising a ball-valve body 32 actuated by pressure via a spring 31 and a valve seat 33 is disposed upstream from the connection 29 of line 17.

In the control loop illustrated in FIG. 1, a very small partial stream is branched off from the lubricating-oil loop and flows through the control line 18. The oil stream entering at connection 20 flows through throttle 21 and the throttle 23 disposed downstream and emerges at connection 22 into the crankcase. By appropriate matching of the cross sections of throttle 21 and throttle 23, it is ensured that the pressure between throttle 21 and throttle 23 depends only slightly on the oil viscosity and the delivery flow of the oil pump in a pressure-controlled oil-supply system. This pressure, decoupled between the two throttles, is always much lower than that in the oil-pressure loop. If the lubricating-oil pressure at connection 20 drops due to low oil level in the oil pan, because of clogging of the oil filter, because of defective oil pump or similar reason, this leads as a result of the suction effect of the crankcase to a further pressure loss in the control line 18. This situation is also referred to as superposition of the pneumatic reduced-pressure peaks, which in each case briefly open check valve 30 and create a constant reduced pressure in reduced-pressure cell 15. The opening pressure $P_{open}$ of check valve 30 is then about 5 mbar. Specifically, the spring 31 in check valve 30 is compressed by the ball-valve body 32 as a result of the reduced pressure prevailing in control line 18 and of the atmospheric pressure prevailing in pressure chamber 19. The reduced pressure developed as a result in pressure chamber 19 causes diaphragm 12 to be moved toward intake bore 5 by the atmospheric pressure present in pressure chamber 16, thus displacing closing tappet 10 with closing body 11 into suction-hole attachment 6. Hereby the fuel stream passing from fuel-feed line 2 via intake duct 4 and suction-hole adapter 6 into intake bore 5 and thus into injection pump 1 is interrupted. Since ambient air is sucked in through throttle 26 and influences the build-up of reduced pressure in the reduced-pressure cell even when fuel interruption begins, the diameter of throttle 26 must be matched to the system. Upstream filter 28 prevents ingress of dirt during this process.

When normal pressure is restored in control line 18, check valve 30 closes and air at atmospheric pressure flows through aperture 27 and throttle 26 of branch line 25 into line 17 and thus via connection 24 into pressure chamber 19 of the reduced-pressure cell. In combination with restoring spring 14, this causes diaphragm 12 and closing tappet 10 connected therewith via pressure plate 13 to move back to their initial position. This in turn brings about opening of suction-hole adapter 6 and thus release of the fuel feed. A seal 9 in the region of the lift rod and a seal 8 between pressure plate and housing then separate the fuel and reduced-pressure areas hermetically from each other.

Figure 2:
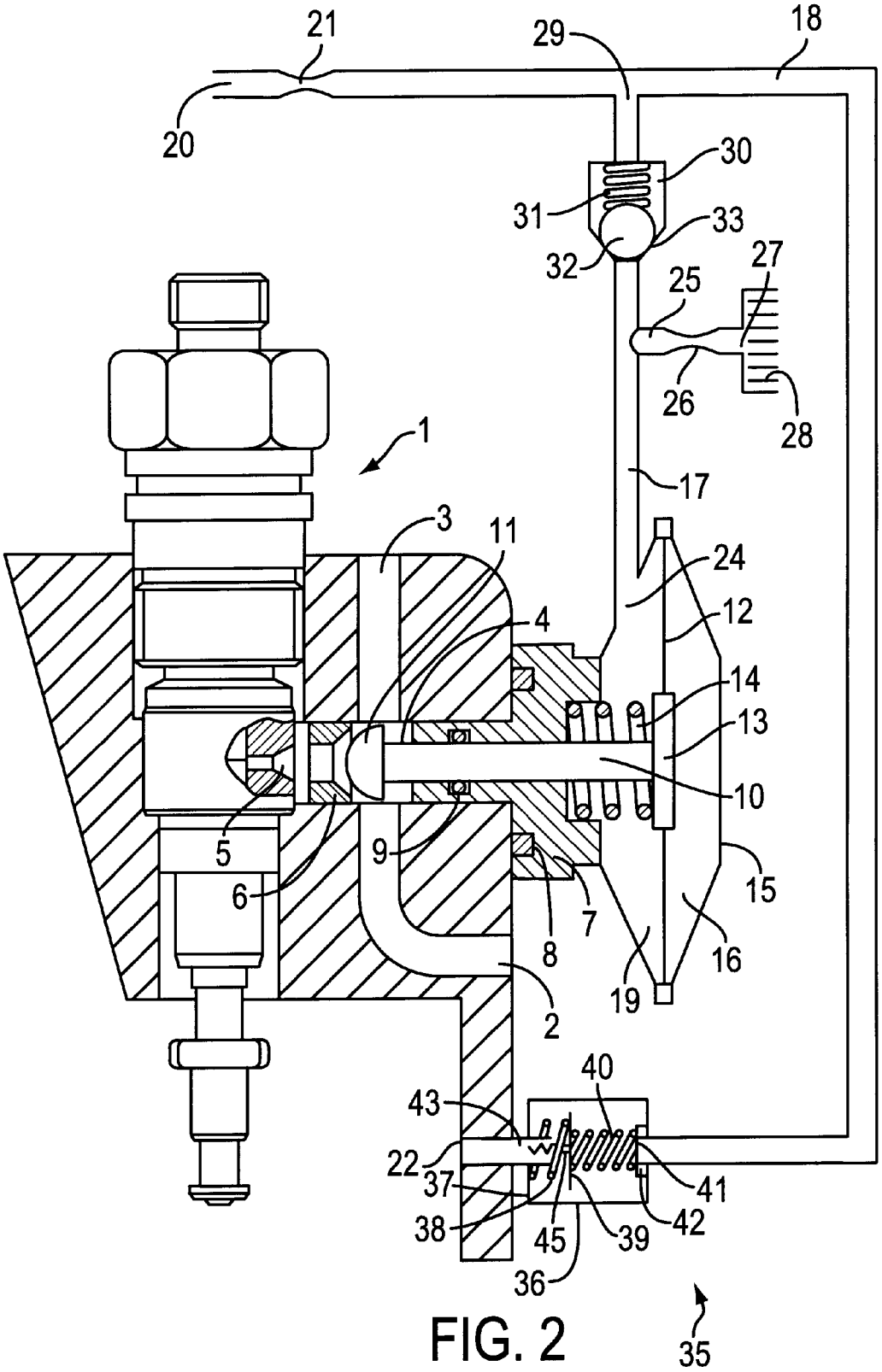
FIG. 2 shows a second embodiment schematically in a sectional representation.

FIG. 2 shows a further embodiment of the present invention. Compared with FIG. 1, a valve 35 instead of throttle 23 is provided herein. Valve 35 has a cylindrical housing 36 against the front end 37 of which there is braced a first helical spring 38. The first spring 38 presses on a valve plate 39, which on its side turned away from the first spring 38 is subjected to pressure by a second spring 40. The second spring 40 in turn is braced at its other end against a further valve plate 41.

By upwardly directed stroke movement of the engine piston, valve 35 allows only a small air flow to pass toward the crankcase, by lifting valve plate 41 from tube opening 42. Because of the air stream the first valve plate 39 is moved toward the second valve opening 43, thus closing the flow path to the crankcase. Thereby the reduced pressure from the crankcase cannot continue to reach the diaphragm of the reduced-pressure cell during this suction stroke. The opening pressure of ball valve 45 is approximately 0.2 to 0.5 bar. Only after several reciprocating movements of the piston (about 50 strokes) is the reduced-pressure cell evacuated and the fuel feed to the injection pump interrupted via diaphragm 12, closing tappet 10 and closing body 11. In the case of proper functions of the lubricating system, however, the necessary oil pressure is present within several revolutions (for example, 50 revolutions) after starting, and the stopping process is not initiated. This means that valve 35 primarily ensures that, during the starting process, the engine is not automatically stopped again immediately because oil pressure is not yet present. This is achieved by the fact that the entire volume of the reduced-pressure cell is not evacuated all at once, but instead stepwise, during reciprocating movement of the engine piston.

Figure 3:
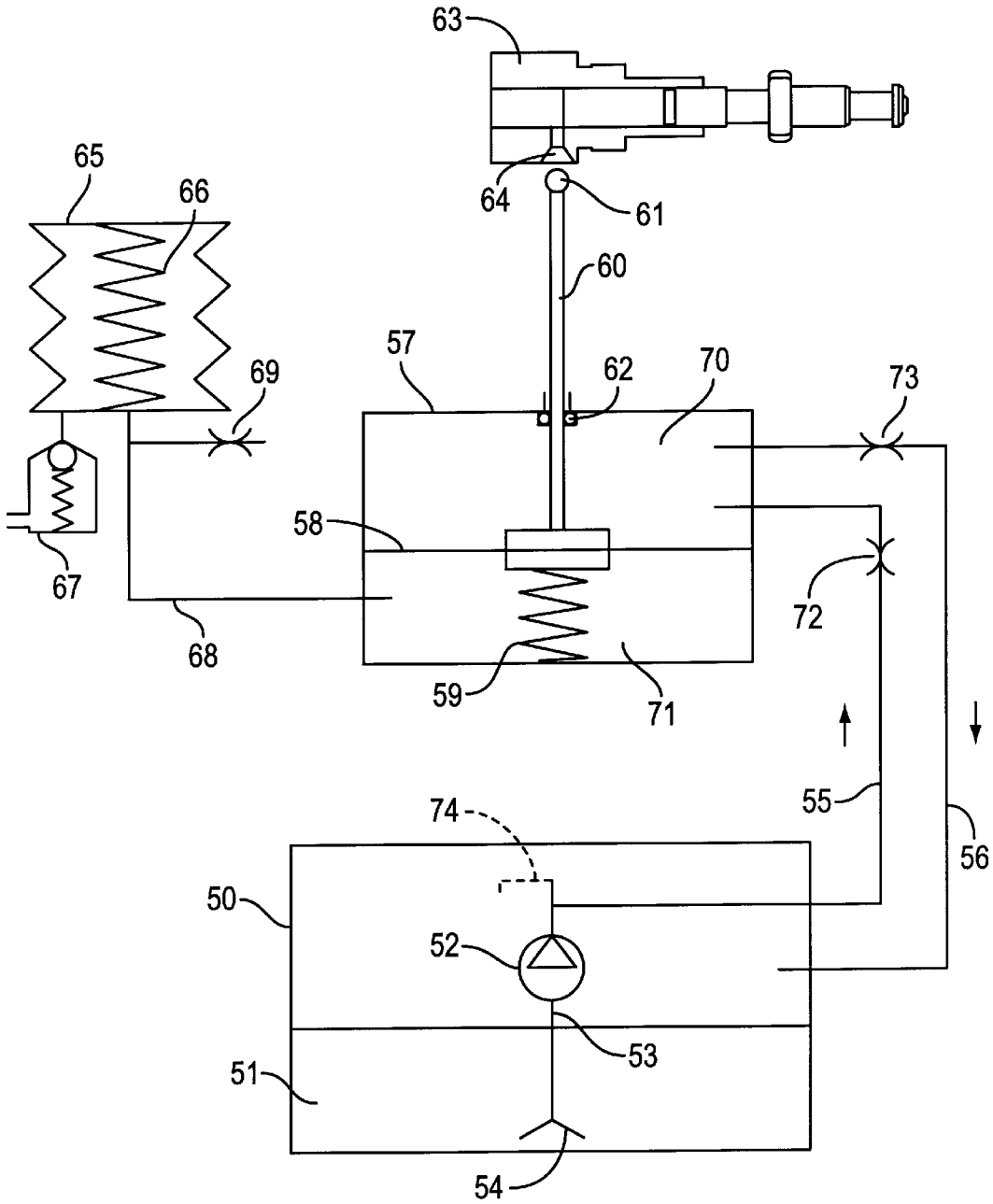
FIG. 3 shows a further embodiment in schematic representation.

FIG. 3 schematically shows a further embodiment of the present invention. Therein, in addition to the features described for the preceding embodiments, there is also illustrated a rubber bellows 65 with check valve 67 as well as a ventilation throttle 69, which acts as the manual evacuation device of the reduced-pressure diaphragm chamber 71.

During normal operation, a very small partial stream is branched off from the lubricating-oil loop 74 and passed via pressurized-oil supply line 55 and the first throttle 72 of the pressure chamber 70 to the reduced-pressure cell 57. The oil is returned to crankcase 50 via the second throttle 73 and the oil-drain line 56. By appropriate matching of the diameters of first and second throttles 72, 73, it is ensured that the pressure in reduced-pressure cell 70 depends only slightly on oil viscosity and delivery flow of the oil pump. This pressure, decoupled between two throttles, is always much lower than the pressure in the oil loop. Valve tappet 60, at the end of which there is disposed a valve body 61, is mounted such that it can be moved easily in axial direction in reduced-pressure cell 57 by means of rubber diaphragm 58 and the guide with seal 62. The oil pressure on diaphragm 58 on the one hand and a compression spring 59 on the other hand activates the valve tappet. At normal pressure in the lubricating-oil loop, the valve tappet is held in the indicated position, against the force of the compression spring, by the corresponding pressure in the reduced-pressure cell. When the oil pressure decreases below a necessary minimum value, the compression spring moves the valve body by means of the valve tappet toward suction hole 64 of pump element 63, and so the fuel feed to the injection pump is interrupted and the engine automatically stopped.

To start the engine, it is necessary to bring the automatic stopping unit by manual operation of a rubber bellows 65 to starting readiness, since oil pressure is not yet present in the reduced-pressure cell during the starting phase. The inside space of the rubber bellows is in communication with the evacuated second pressure chamber 71 via the evacuation line 68. By compressing the rubber bellows, air is forced out through check valve 67. By subsequent expansion of the rubber bellows, assisted by compression spring 66, air is sucked out of the second pressure chamber of the reduced-pressure cell. Thereby the valve tappet and thus the valve body is moved by the diaphragm against the force of the compression spring, thus enabling fuel feed at the suction hole. Starting readiness of the engine is thus created. Once starting has been achieved, the rapidly built-up oil pressure takes over the function of keeping the suction hole open. After a limited time, the generated vacuum is broken again via a ventilation throttle 69, so that starting readiness exists only briefly. Typical times for this purpose are about 10 seconds. The diameter of the ventilation throttle is matched accordingly. If the engine has not yet started within this time, the rubber bellows must be compressed once again. Once engine starting has been achieved successfully within this predetermined time interval, the automatic stopping system becomes active again after the vacuum has been broken. Then, for example, if sufficient oil is not already present in the oil pan during starting, the engine is stopped again after the vacuum has been broken.

Figures 4, 5:
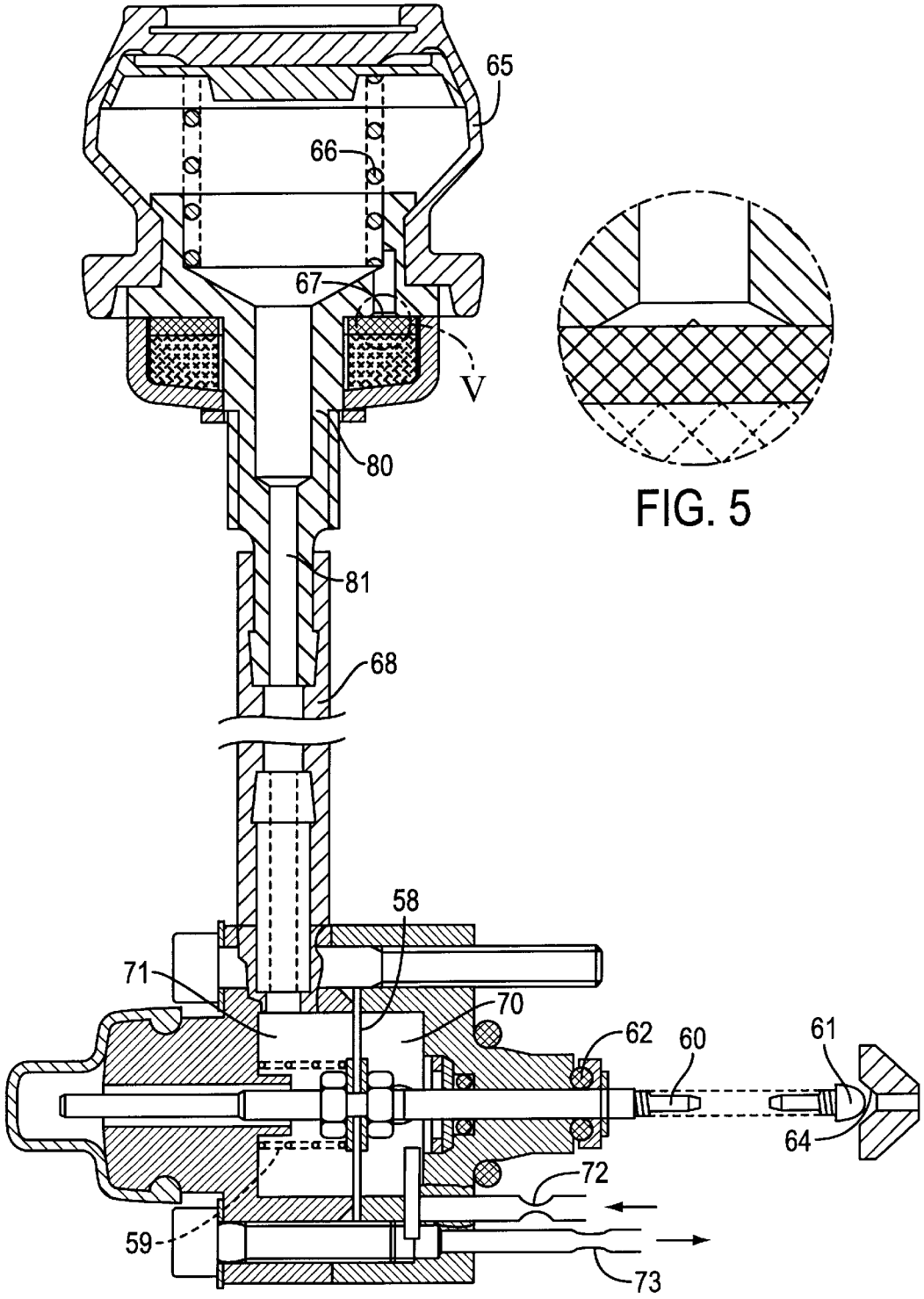
FIG. 4 shows a manual evacuation device in a sectional representation.
FIG. 5 shows a detail according to FIG. 4.
Figure 1:
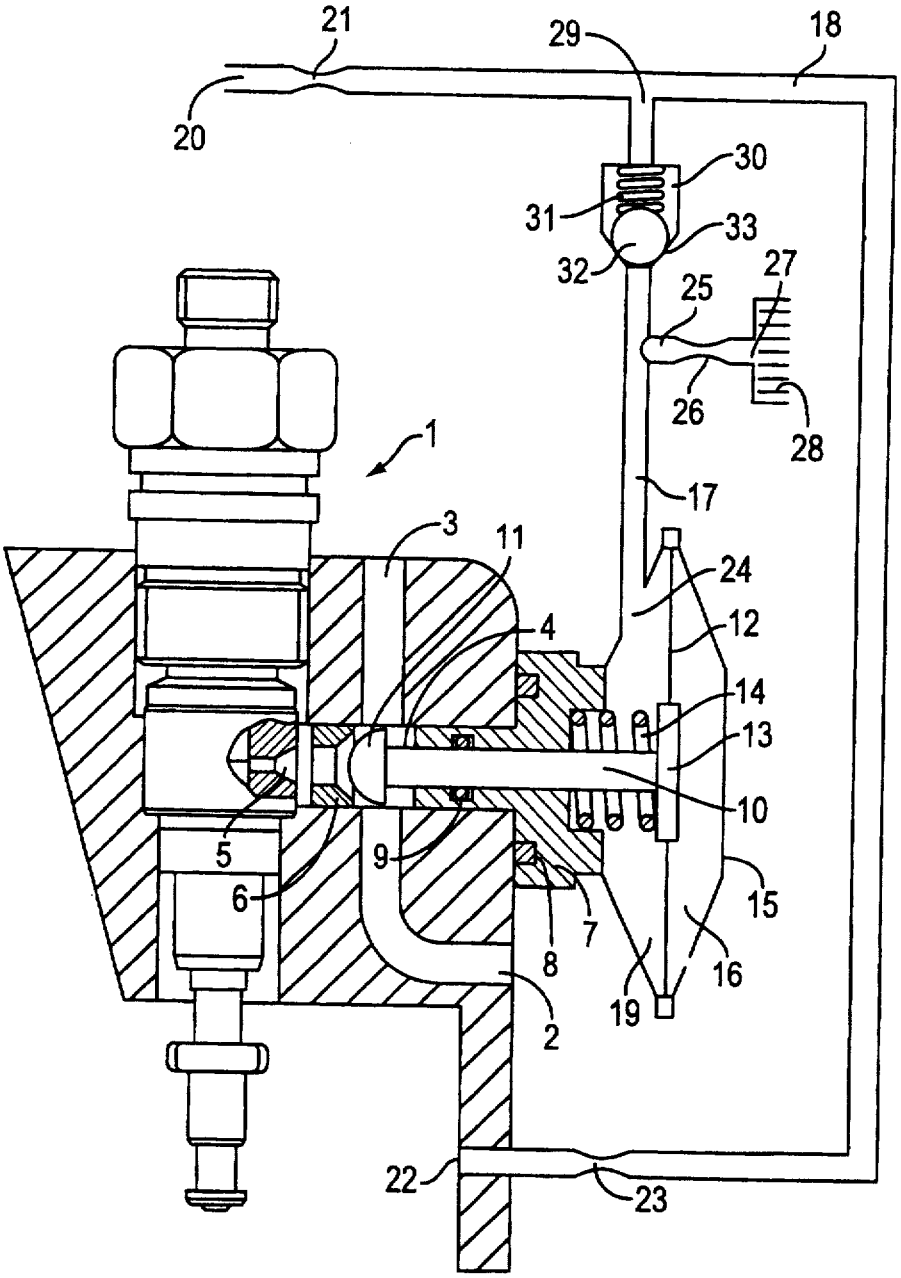
Figure 2:
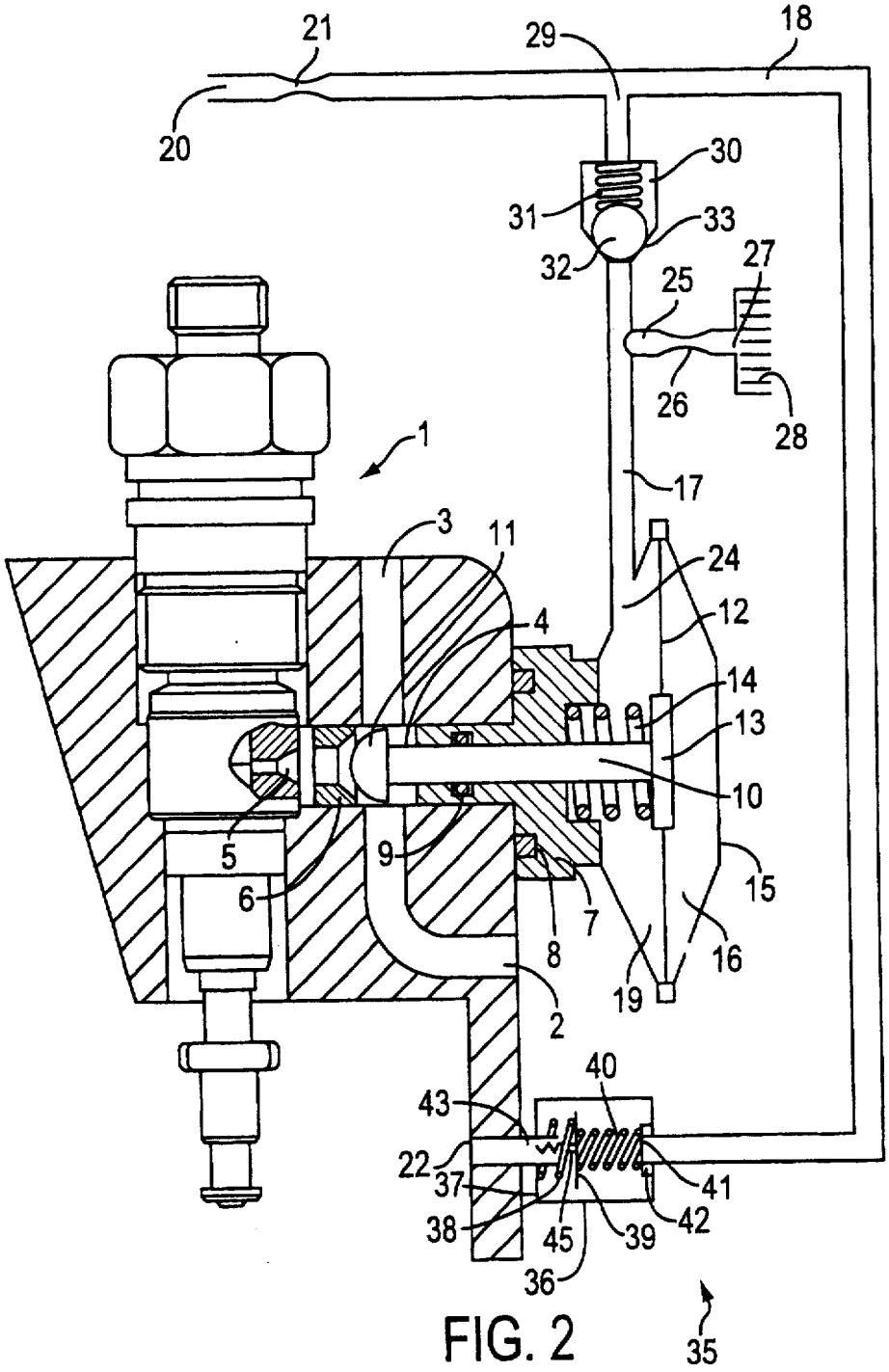

FIG. 4 shows a sectional view of an embodiment of a manually-operated rubber bellows according to FIG. 3. Therein the rubber bellows 65, the compression spring 66 and a check valve 67 are illustrated. Also illustrated is a basic part 80, which at its upper end holds the spring 66 and also provides, on its outer periphery, a firm and leakproof support for rubber bellows 65. Furthermore, the basic part 80 is provided in its longitudinal direction with a bore 81, which at the lower end of the basic part opens into a pressure tube 68. The pressure tube 68 in turn is in communication with the second pressure chamber 71 of the reduced-pressure cell.

FIG. 5 shows detail V from FIG. 4. This is the return-valve aperture of valve 67, which can simultaneously function as throttle 68.

What is claimed is:

1. An internal combustion engine, in which a mechanical safety device is provided for automatic interruption of the fuel supply in the event of lubricating-oil deficiency wherein as the final controlling element of a control loop there is provided a reduced-pressure cell (15; 57) with a diaphragm (12; 58) for exerting pressure on a closing tappet (10; 60; 60), said reduced pressure cell (15; 57) being subdivided by the diaphragm, (12; 58) into a first pressure chamber (16; 71) open to the atmosphere and a second pressure chamber (19; 70) subjected to pneumatic reduced pressure and in that there are provided a control line means (18; 55; 56) with a connection (20) on the oil-loop side and a connection (22) on the crankcase side to generate a reduced pressure in said second pressure chamber (19) and a restoring spring (14; 59) acting on the diaphragm (12; 58) for automatic restoration on the fuel feed.

2. An internal combustion engine according to claim 1, wherein the fuel-injection system is provided with a fuel-injection pump (1; 63) with a suction hole (5; 64), the closing tappet (10; 60) being provided to close the suction hole (5; 64).

3. An internal combustion engine according to claim 1, wherein, the closing tappet (10; 60) is permanently joined to the diaphragm (12; 58).

4. An internal combustion engine according to claim 1, wherein, on the side facing away from the diaphragm (12), the restoring spring (14) acts on a pressure plate (7).

5. An internal combustion engine according to claim 1, wherein, the closing tappet (10; 60) is of self-centering construction.

6. An internal combustion engine according to claim 1, wherein, two throttles (21, 23; 72, 73) are provided in the control line, one downstream from the connection (20) on an oil-loop side and the other upstream from the connection (22) on a crankcase side, in order to make the line pressure independent of oil viscosity and delivery flow of the oil loop.

7. An internal combustion engine according to claim 1, wherein, a throttle (21) is provided in the control line (18) downstream from the connection (20) on an oil-loop side and a valve (35) is provided upstream from the connection (22) on a crankcase side.

8. An internal combustion engine according to claim 1, wherein, a line (17) in communication at one end with the reduced-pressure cell (15) is provided in the control element for evacuating and ventilating the pressure chamber (19), at its other end this line being in communication via a check valve (30) with the control line (18) and a ventilation throttle (26) with the atmosphere.

9. An internal combustion engine, according to claim 1, wherein there is provided a first control line (55) with a connection on an oil-loop side and a second control line (56) with a connection on a crankcase side in the control element.

10. An internal combustion engine according to claim 9, wherein, there is provided an evacuation device for manual evacuation of the side which is connected to the atmosphere of the diaphragm (58).

11. An internal combustion engine according to claim 10, wherein, as the evacuation device there is provided a check valve (67), a rubber bellows (65) with a compression spring (66), a ventilation throttle (69) and an evacuation line (68).

* * * * *

UNITED STATES PATENT AND TRADEMARK OFFICE

CERTIFICATE OF CORRECTION

PATENT NO. : 6,085,716
DATED : July 11, 2000
INVENTOR(S) : Guenter Kampichler, et al.

It is certified that error appears in the above-identified patent and that said Letters Patent is hereby corrected as shown below:

Please replace Drawings for "Figure 1 and Figure 2" (Sheet 1 of 4 and 2 of 4) with the attached Corrected Drawings of "Figure 1 and Figure 2".

Signed and Sealed this

Fourteenth Day of August, 2001

*Attest:*

Nicholas P. Godici

*Attesting Officer*

NICHOLAS P. GODICI
*Acting Director of the United States Patent and Trademark Office*